US011746606B2

(12) United States Patent
Casadei et al.

(10) Patent No.: US 11,746,606 B2
(45) Date of Patent: Sep. 5, 2023

(54) METHOD OF MOUNTING A KELLY BAR ON A DRILLING MACHINE, RELEVANT MOUNTING TOOL AND A DRILLING MACHINE EQUIPPED WITH SUCH MOUNTING TOOL

(71) Applicant: SOILMEC S.P.A., Cesena (IT)

(72) Inventors: Marco Casadei, Cesena (IT); Primo Smeraldi, Cesena (IT)

(73) Assignee: SOILMEC S.P.A., Cesena (IT)

( * ) Notice: Subject to any disclaimer, the term of this patent is extended or adjusted under 35 U.S.C. 154(b) by 0 days.

(21) Appl. No.: 17/391,200

(22) Filed: Aug. 2, 2021

(65) Prior Publication Data

US 2022/0042382 A1 Feb. 10, 2022

(30) Foreign Application Priority Data

Aug. 7, 2020 (IT) ..... 102020000019756

(51) Int. Cl.

| | |
|---|---|
| ***E21B 7/02*** | (2006.01) |
| ***E21B 19/24*** | (2006.01) |
| ***E21B 3/00*** | (2006.01) |

(52) U.S. Cl.

CPC ..... *E21B 19/24* (2013.01); *E21B 3/00* (2013.01); *E21B 7/02* (2013.01)

(58) Field of Classification Search

CPC ..... E21B 7/02

See application file for complete search history.

(56) References Cited

U.S. PATENT DOCUMENTS

| | | | | |
|---|---|---|---|---|
| 5,320,363 | A * | 6/1994 | Burnham | E21B 11/005 294/50.8 |
| 5,746,277 | A | 5/1998 | Howell, Jr. | |
| 8,397,833 | B2 * | 3/2013 | Stoetzer | E21B 7/023 173/28 |

FOREIGN PATENT DOCUMENTS

| | | | |
|---|---|---|---|
| GB | 2376248 | A | 12/2002 |
| JP | 2006009299 | A | 1/2006 |
| JP | 3750777 | B2 | 3/2006 |
| JP | 3765517 | B2 | 4/2006 |

OTHER PUBLICATIONS

Search Report dated Apr. 7, 2021 in Italian Patent Application No. 202000019756 (with English translation of categories).

* cited by examiner

*Primary Examiner* — Giovanna Wright

(74) *Attorney, Agent, or Firm* — Element IP, PLC

(57) ABSTRACT

A method of mounting a kelly bar on a drilling machine includes a step of installing a mounting tool between the rod of a pull-down cylinder and a rotary carriage of the drilling machine. Once the mounting tool has been installed, the drilling machine can be set up with a kelly bar that is longer than the usual kelly bars.

8 Claims, 5 Drawing Sheets

METHOD OF MOUNTING A KELLY BAR ON A DRILLING MACHINE, RELEVANT MOUNTING TOOL AND A DRILLING MACHINE EQUIPPED WITH SUCH MOUNTING TOOL

The present invention refers to a method of mounting a kelly bar on a drilling machine.

The present invention further concerns a mounting tool for kelly bars on drilling machines.

A drilling machine with the above-mentioned mounting tool is also an object of the present invention.

The present invention is placed in the field of tools for making bored foundation piles, made by means of a battery of telescopic bars, known in the sector with the name of "kelly bar", equipped with a corresponding digging tool. The kelly bar is moved by means of a rotating head referred to in the sector as the a "drilling rotary". The drilling rotary slides on a guide tower, which develops mainly vertically, of a drilling machine and is arranged to transmit both a rotation and a translation motion to the kelly bar which causes the advancement of the tool in the ground. The guide tower is constrained in a tilting way to a "base machine" which consists of an undercarriage arranged to translate the machine on the ground and of a turret superimposed on the undercarriage. The turret can rotate around a vertical axis and is arranged to support the guide tower by means of a hinge connection or a dedicated kinematic mechanism In detail, the drilling rotary is equipped with a rotating annular element, called in the sector as a "drive sleeve", which defines, through it, a suitable annular passage into which the kelly bar is inserted.

The construction of bored poles by means of the kelly bar involves the use of a suitable digging tool that is connected to the lower end of the kelly bar itself, from which it receives the torque and thrust necessary to drill the ground. This is a discontinuous drilling technique that is performed by first making the tool advance by an amount equal to its length so that it is filled with the dug soil and then by lifting it out of the excavation to discharge the soil collected during the advancement.

The tool in question usually has the shape of an auger, or cup or drilling "bucket". The auger has a conical geometric shape and is equipped with one or more concentric turns, which wrap around a central cylindrical element. The lower part of the auger is equipped with cutting elements, known as teeth, which allow the ground to be broken up as the tool advances. The drilling bucket, on the other hand, is a hollow cylindrical tool, equipped with a lower closing hatch, which comprises openings that allow debris to pass therein during the advancement, so that the internal volume of the tool can be filled as much as possible. The lower closing hatch is also equipped with teeth similar to those used on the auger. When the tool comes out, the closing hatch is opened to allow the debris accumulated inside the tool during digging to be discharged.

In order to be able to use these tools for the execution of deep excavations, the kelly bar consists of an assembly of cylindrical elements with a hollow section, of different diameters and that are coaxially coupled.

Each cylindrical element is equipped with axial abutments located at the ends which prevent the complete disengagement of one element with respect to the adjacent ones. Each cylindrical element is equipped with ribs which, during rotation, come into contact with the ribs of the other cylindrical elements of the kelly bar, thus allowing the transmission of torque from the outermost cylindrical element up to the innermost cylindrical element. At the top of the outermost cylindrical element of the kelly bar, there may be a guide element equipped with a bearing that slides on corresponding sliding guides of the guide tower of the drilling machine so as to keep the kelly bar on the correct vertical axis. The bearing ensures free rotation of the kelly bar.

In relation to the transmission of motion between the drilling rotary and the kelly bar, the drive sleeve of the drilling rotary is equipped with special abutments that interact with the ribs of the outermost cylindrical element of the kelly bar to drive the latter in rotation and translation.

The kelly bar is also connected, by means of a special top rotatable element, to a rope which is operated by a main winch positioned on the body or on the guide tower of the drilling machine.

Starting from the winch, the rope is driven by means of one or more pulleys of a head placed at the top of the guide tower, to connect to the rotatable element of the kelly bar. A pulley of the head is aligned with the kelly bar so that the rope coming out of this pulley substantially mates with the longitudinal axis of the kelly bar. The actuation of the winch rope allows the vertical translation of the kelly bar and of the tool carried by it, so that both undergo a relative axial sliding both with respect to the drilling rotary and with respect to the guide tower of the drilling machine. In order to avoid mechanical impacts between the kelly bar and the head, the sliding of the kelly bar towards the upper part of the guide tower is limited.

The drilling rotary can also slide in a longitudinal direction with respect to the guide tower, as it is fixed to a special carriage called the "rotary carriage", which is equipped with sliding shoes that translate along side guides that are present on the guide tower.

When the drilling rotary is translated along the guide tower it can, depending on the direction of translation, impart a pulling action to the cylindrical elements of the kelly bar to extract the tool from the ground or a pushing action to advance the tool into the ground while drilling.

The action of translating the drilling rotary to transmit a pull or thrust to the kelly bar is referred to in the drilling sector as a "pull-down" action or manoeuvre.

In order to generate a pull-down action, the rotary carriage can set in translation by means of a system of ropes connected to the carriage by means of pulleys. The ropes are driven by a special winch, called "pull-down winch". The pull-down winch can make the drilling rotary travel a very large stroke along the guide tower and this stroke is limited only to avoid impacts of the drilling rotary with other parts of the drilling machine that are at both ends of the guide tower.

Alternatively, the rotary carriage can be connected to a hydraulic cylinder to be moved along the guide tower, instead of being connected to a system of ropes and pulleys. This cylinder actuator, known as a "pull-down cylinder", is connected through one end thereof to the guide tower, e.g. by a pin coupling. The other end of the pull-down cylinder is coupled, e.g. through an additional pin, to the rotary carriage.

The width of the sliding of the rotary carriage with respect to the guide tower, known as the stroke, is equal to the extension of the rod of the pull-down cylinder. Similarly, the lower and upper position that can be reached by the carriage and by the drilling rotary along the guide tower depends on the stroke and on the length of the cylinder and on the position of the fixing point of the cylinder on the guide tower.

The kelly bar allows the desired total digging depth to be reached as a function of the number and length of the single telescopic cylindrical elements that make it up. The various telescopic cylindrical elements slide axially with respect to each other according to a measure approximately equal to their own length until they meet the abutments that are placed at their ends.

The installation of a kelly bar on a drilling machine is a complex operation that generally involves exploiting the entire free space available between the top of the drilling rotary and the head placed at the upper end of the guide tower. In order to install the kelly bar, in a drilling machine with drilling rotary already installed on the guide tower, first of all the drilling rotary is positioned at the lower end of its stroke along the guide tower. In the case where the movement of the drilling rotary (i.e. the pull-down action) is actuated by means of a hydraulic cylinder, the lower position of the drilling rotary is obtained by completely sliding off the rod of the cylinder.

It should be noted that the length of the cylinder and its stroke are established at the design stage to prevent, in the condition of maximum extension of the cylinder, the rotary carriage from being able to protrude below the lower limit of the guide tower.

In fact, the rotary carriage comprises upper and lower guide seats equipped with shoes suitable for coupling to the guides of the guide tower and for transmitting the forces between the latter.

Under digging operating conditions, when the drilling rotary is operated to apply torque to the tool, some of that torque is transmitted from the carriage to the guides. The length of the guide seats and of the shoes is sized to transmit the forces to the corresponding guides by distributing them over a sufficiently large surface to avoid excessive surface contact loads at the guides.

The pull-down cylinder does not allow the rotary carriage to protrude below the lower edge of the guide tower to avoid the danger of damage or deformation of the relevant guides and seats.

Generally, in a disassembled condition from the drilling machine, the kelly bar is placed on the ground or on special stands completely and is retracted and without the digging tool.

When the kelly bar is to be mounted on the drilling machine, the latter is moved in such a way that the respective guide tower is brought close to the kelly bar. Once the optimal position for carrying out the first mounting operations has been reached, the rotatable attachment of the kelly bar, which is located at its upper end, is connected to the main winch rope. The kelly bar is slowly raised until it reaches a vertical position with the lower end disposed above with respect to the drive sleeve of the drilling rotary which defines the passage for the kelly bar.

In the case in which the guide tower has initially inclined forward in such a way that the upper end of the guide tower is moved away from the body of the drilling machine and the lower end of the guide tower is moved close to the body of the drilling machine, the kelly bar can be lifted more easily until it is suspended, remaining suspended vertically under the effect of gravity with no danger of hitting the drilling rotary or the lower part of the guide tower.

At this point, the guide tower is gradually returned to the vertical position. During this manoeuvre, as the guide tower approaches the vertical, the kelly bar approaches the guide tower until they become mutually parallel. In this position, it is possible to centre the lower end of the kelly bar with the drive sleeve of the drilling rotary.

Once the kelly bar and the drive sleeve of the drilling rotary are aligned, the main winch that holds the kelly bar suspended is activated to lower the latter into the drive sleeve of the drilling rotary until the drive sleeve is crossed by the kelly bar. If the kelly bar is further lowered, its lower end protrudes below the drilling rotary to allow the tool to be connected.

If the space between the upper end of the drilling rotary and the head is less than the length of the fully retracted kelly bar, i.e. in a minimum length condition, it becomes particularly difficult, if not impossible, to assemble the kelly bar to the drilling machine.

Therefore, it is not possible to use kelly bars that are longer than the above defined space between the drilling rotary and the head, unless the drilling rotary is disassembled from the guide tower, or the upper head is removed from the guide tower, or even to make mechanisms that temporarily move the head with respect to the guide tower to allow the passage of a longer kelly bar. In such cases, it is necessary to also make use of a crane or similar lifting equipment capable of handling significant loads. In one of these cases, a crane can be used to support the drilling rotary when it is separated from the guide tower. In another case, having dismantled or moved the head equipped with the pulleys, it is no longer possible to use the main winch rope of the drilling machine to lift the kelly bar and therefore it is necessary to make use of a crane or similar means to carry out this lifting. In both of these cases, the advantage of the "self-assembly" feature of the drilling machine and/or of the kelly bar is lost.

It should also be noted that the overall dimensions of the drilling rotary and the rotary carriage, even if they are brought to their lowest operating position through the pull-down cylinder, hinder the installation of kelly bars with significant lengths, so it is necessary to use kelly bars of a reduced length compared to the length of the guide tower of the drilling machine.

It should be pointed out that a reduction "R" in the length of the kelly bar leads to a reduction in the digging depth equal to the product of "R" times the number of the telescopic cylindrical elements that make up the kelly bar.

This limitation is even more accentuated in the presence of drilling machines equipped with guide towers of reduced dimensions. In this case, the reduction in length of the kelly bar, compared to the length of the guide tower, has a higher percentage value and a greater incidence. In these machines, kelly bars consisting of a larger number of telescopic cylindrical elements are often used.

The main object of the present invention is that of solving the problems encountered in the prior art. It is an object of the present invention to allow mounting relatively longer kelly bars, and in any case of a length greater than the maximum space between the drilling rotary and the head under operating conditions, without having to resort to the use of cranes or similar auxiliary lifting machinery and without disassembling the groups making up the drilling machine.

It is also an object of the present invention to minimise or even avoid all machine downtimes and idle times normally required for setting up the drilling machines, when it is necessary to mount kelly bars of significant lengths or in any case longer than the maximum space between the drilling rotary and the head under operating conditions.

These and other objects are substantially achieved by a method of mounting a kelly bar on a drilling machine, a relevant mounting tool, and a drilling machine equipped with such a mounting tool according to the present invention.

Further features of the mounting method, the relevant mounting tool and the drilling machine equipped with such mounting tool according to the invention will be shown by the following description and claims.

The characteristics and advantages of the mounting method and the relevant mounting tool will be more evident from the following description, which is a non-limiting example, referring to the attached schematic drawings in which.

Figure 1:
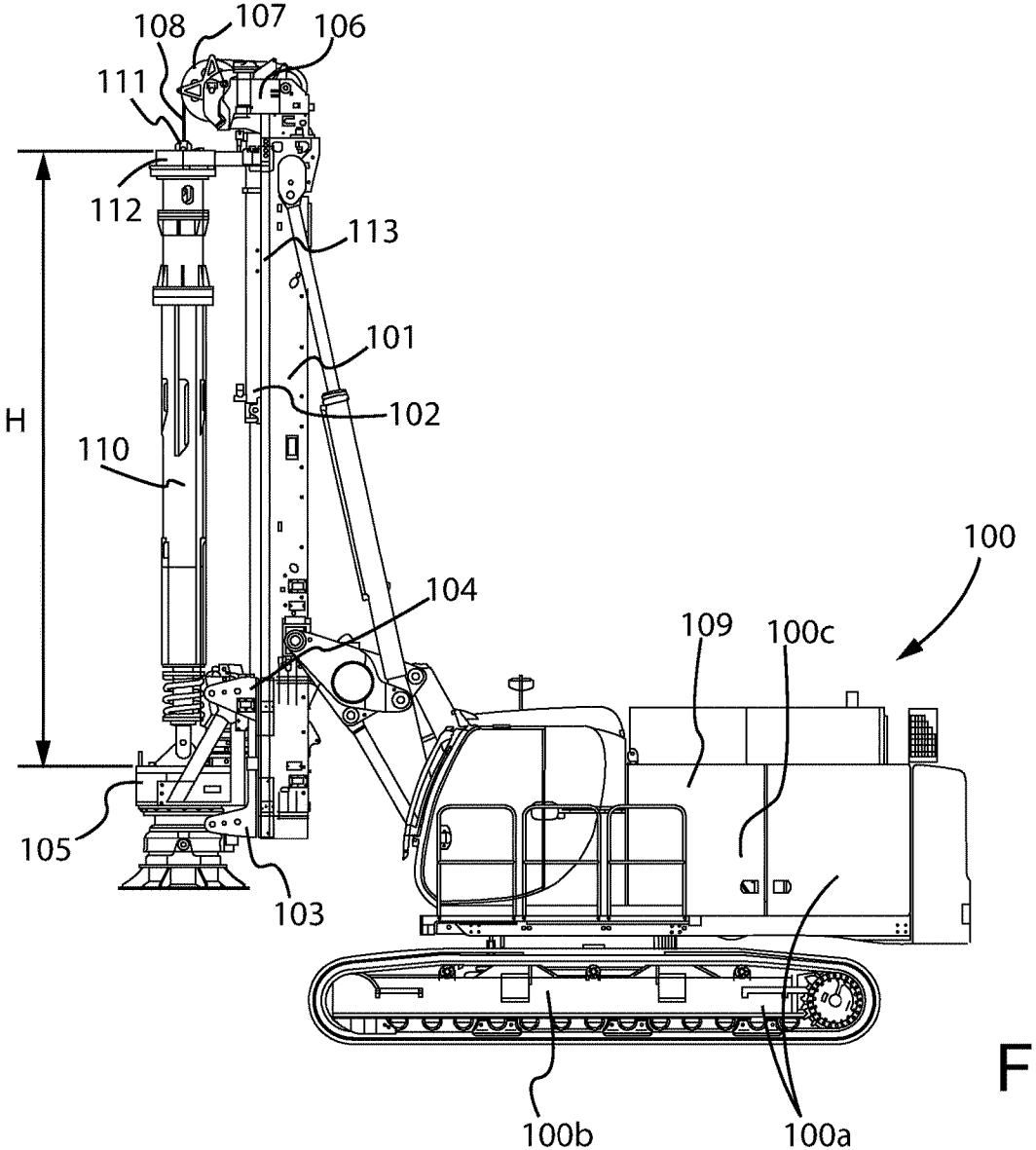
FIG. 1 is a schematic side elevation view of a drilling machine equipped with a kelly bar, in accordance with the present invention.

With reference to FIG. 1, the number 100 generally indicates a drilling machine.

As can be seen in FIG. 1, the drilling machine 100 is equipped with a guide tower 101 which is inclinably constrained to a base body 100*a* consisting of an undercarriage 100*b* arranged to translate the drilling machine 100 on the ground and of a turret 100*c* superimposed on the undercarriage 100*b*. The turret 100*c* can be rotated around a vertical axis and is arranged to support the guide tower 101 by means of a hinge connection or a dedicated kinematic mechanism.

The guide tower 101 is equipped with a pull-down cylinder 102 arranged to slide a rotary carriage 103 along the guide tower itself. The rotary carriage 103 is directly or indirectly connected by means of further components which will be described below to one end of the pull-down cylinder 102 by means of a respective fixing pin 104.

A drilling rotary 105 is connected to the rotary carriage 103, while a drill head 106 is disposed at the top of the guide tower 101. The head 106 houses some components which will not be mentioned as they are not relevant for the purposes of the invention, and a pulley 107, on which a rope 108 slides which is moved by a main winch 109 (FIG. 1) of the drilling machine 100. At one end of the rope 108 there is fixed a rotatable element 111 which is in turn connected to an upper end of a digging battery or, more commonly referred to as a kelly bar 110, already described in detail in connection with the prior art. In detail, the rotatable element 111 is connected to an upper end of an innermost hollow telescopic cylindrical element of the kelly bar 110.

The kelly bar 110 consists of an assembly of hollow cylindrical elements of different diameters that are coaxially coupled. Each cylindrical element is equipped with axial abutments located at the ends which prevent the complete disengagement of one element with respect to the adjacent ones. Each cylindrical element is equipped with ribs which, during rotation, come into contact with the ribs of the other cylindrical elements of the kelly bar, thus allowing the transmission of torque from the outermost cylindrical element up to the innermost cylindrical element. At the top of the outermost cylindrical element of the kelly bar, there may be a guide element equipped with a bearing that slides on corresponding sliding guides of the guide tower of the drilling machine 100 so as to keep the kelly bar 110 on the correct vertical axis. The bearing ensures free rotation of the kelly bar 110.

The kelly bar 110 may further be connected to the guide tower 101 of the drilling machine 100 by means of an element or upper guide carriage 112, which also slides longitudinally, like the rotary carriage 103, on corresponding guides 113 of the guide tower 101. In the event that it is necessary to mount a kelly bar 110 having a length less than a distance H, defined as the distance between the top plane of the drilling rotary 105 and the bottom plane of the head 106, the traditional mounting method, already described in detail in relation to the prior art, can be carried out.

Conversely, in the event that it is necessary to mount a kelly bar 110 having a length greater than the distance H, without having to disconnect the drilling rotary 105 from the guide tower 101 when the drilling machine 100 is in a working configuration, the relevant mounting method involves the use of a suitable mounting tool 200 (FIGS. 3, 4, 5B and 5C) which will be described below.

Figure 2C:
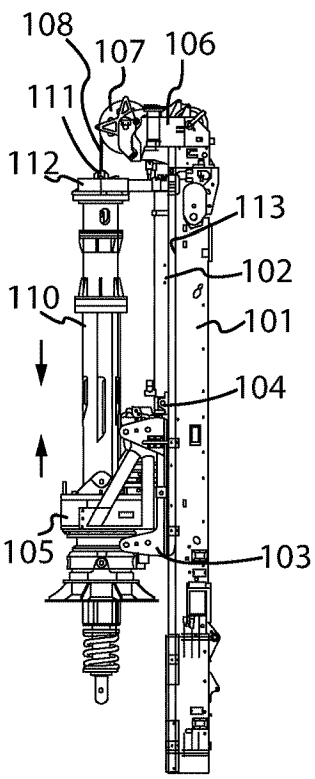
FIGS. 2A, 2B, 2C are schematic side elevation views of a guide tower/kelly bar assembly of the drilling machine in FIG. 1 illustrating the steps of mounting the kelly bar on the respective guide tower without mounting tool.
Figure 2B:
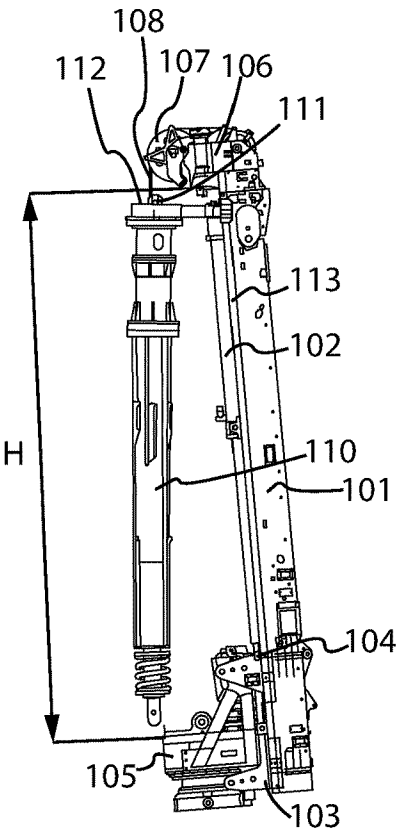
Figure 2A:
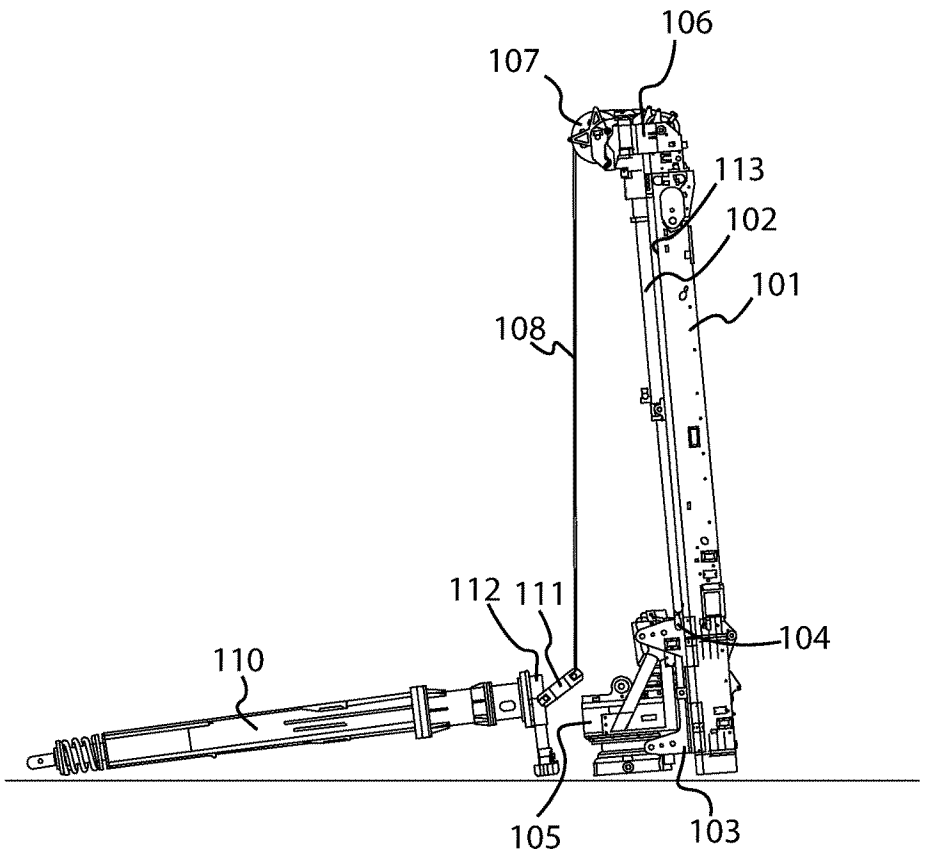

With reference to the mounting of a kelly bar 110 having a length less than the above-mentioned distance H, schematically represented in FIGS. 2A, 2B and 2C, the rotary carriage 103, carrying the peroration rotary, 105 is directly fixed to the pull-down cylinder 102 by means of the fixing pin 104.

The rotary carriage 103 and the drilling rotary 105 are brought to the lowest possible position by fully extending the pull-down cylinder 102. The maximum distance H between the top plane of the drilling rotary 105 and the bottom plane of the head 106 is then obtained.

With reference to FIG. 2A, the kelly bar 110 is initially placed on the ground or, possibly on special stands, in an almost horizontal or horizontal position. The guide tower 101 is brought at the kelly bar 110 and can be inclined slightly forward, towards the kelly bar 110 itself. By means of the main winch 109, which is not shown as it is known, the rope 108 is lowered until the end of the rope 108 is close to the rotatable element 111.

After having hooked, by means of a special pin, the rotatable element 111 to the end of the rope 108, the kelly bar 110 is slowly raised until it reaches a vertical position, as shown in FIG. 2B. At this point, the alignment of the upper guide element 112 is carried out, if applicable.

Next, the guide tower 101 is slowly brought to a vertical position and the kelly bar 110 is lowered until it engages, in a known manner, with the drilling rotary, as shown in FIG. 2C.

Alternatively, the kelly bar 110 may be held in a suspended position and the drilling rotary 105 may be raised until it engages, in a known manner, with the kelly bar 110.

As can be seen from FIGS. 1, 2A, 2B and 2*c*, the maximum length that the kelly bar 110 may have in this case in order to proceed with the mounting as described above must be less than the distance H.

Instead, with reference to the mounting of a kelly bar 110 having a length greater than the aforementioned distance H, the mounting tool 200 used may have different configurations.

Figure 3:
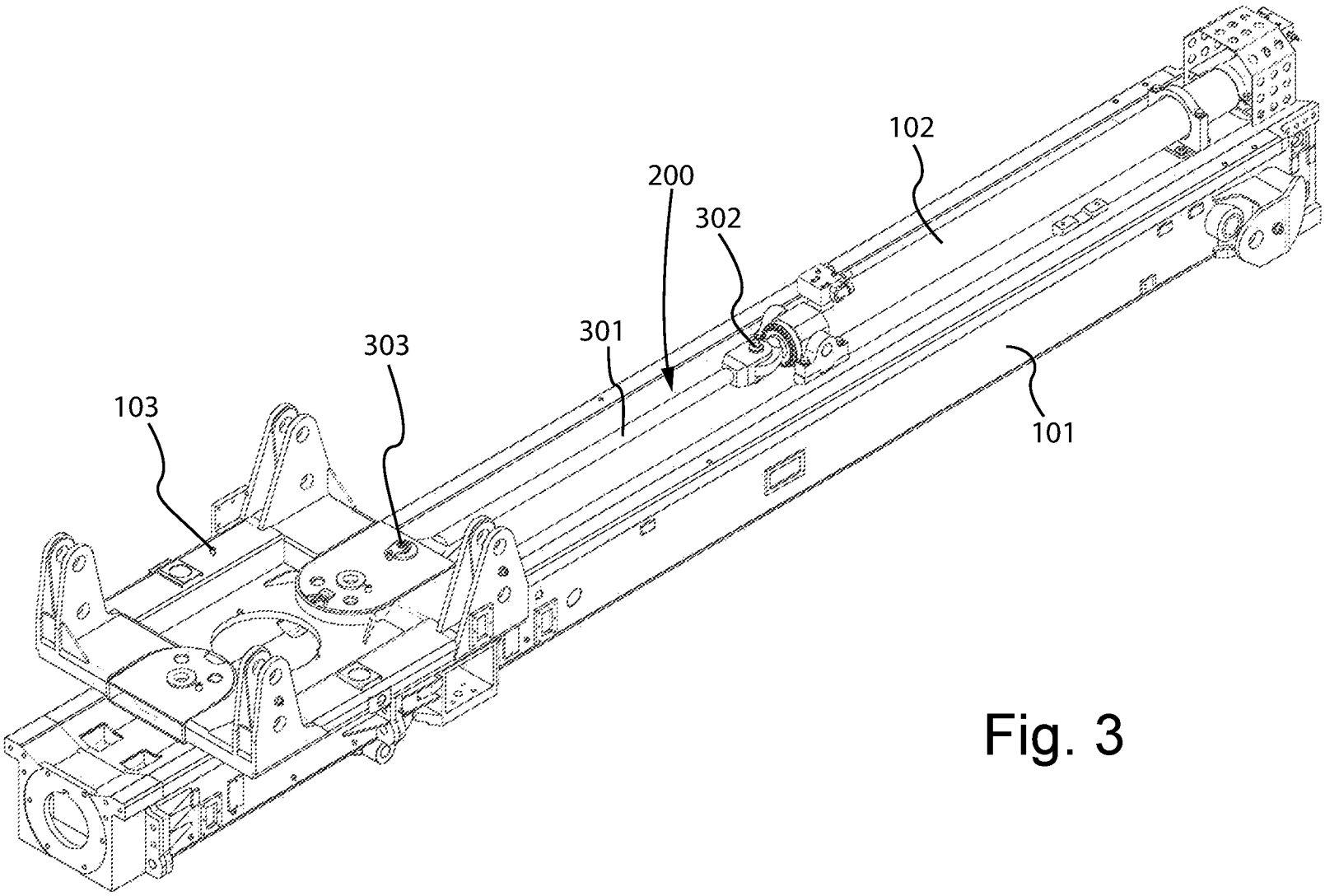
FIG. 3 is a perspective view of the guide tower of the drilling machine illustrated in FIG. 1 equipped with a mounting tool in accordance with a first embodiment variant of the present invention.

In accordance with a first embodiment of the present invention, illustrated in FIG. 3, the mounting tool 200 comprises a traction element 301 which may be rigid or flexible. In FIG. 3, the drilling rotary 105 is not shown to allow for a better view of the traction element 301 and the fixing thereof to the rotary carriage 103, but it is to be understood that in the condition of mounting the kelly bar 110, the drilling rotary 105 is connected to the rotary carriage 103. The traction element 301 which is mounted between the rod of the pull-down cylinder 102 and the rotary carriage 103. In detail, the ends of the traction element 301 are fixed, by means of corresponding pins 302 and 303, to the rod of the pull-down cylinder 102 and to the rotary carriage 103 respectively.

The mounting of the traction element 301, during the machine set-up phase, makes it possible that following a complete extension of the pull-down cylinder 102 the rotary carriage 103 and the drilling rotary 105 itself can be lowered until they protrude below the lower end of the guide tower 101 therefore at a lower level than the level normally attainable in the absence of the traction element 301.

Figure 4:
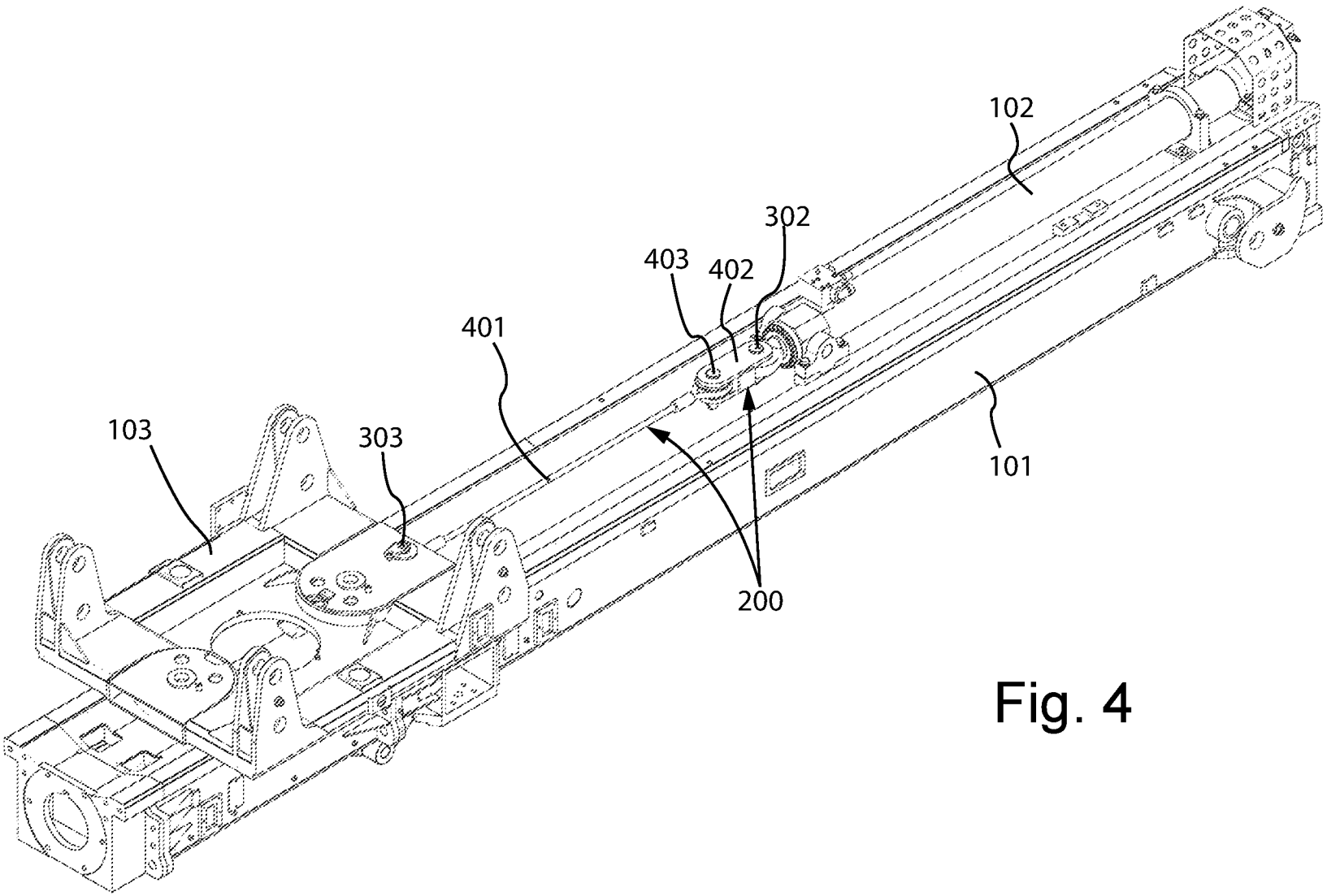
FIG. 4 is a perspective view of the guide tower of the drilling machine illustrated in FIG. 1 equipped with a mounting tool in accordance with a second embodiment variant of the present invention.

In accordance with a second embodiment illustrated in FIG. 4, the mounting tool 200, comprises more than one traction element 401, 402 interposed between the rod of the pull-down cylinder 102 and the rotary carriage 103. In particular, the mounting tool 200 comprises a first traction element 401, preferably flexible, and a second rigid traction element 402 that are connected to each other by means of a connection pin 403. The second traction element 402 is interposed between the rod of the pull-down cylinder 102 and the first traction element 401 in such a way that it is, in an operating condition, positioned above the first traction element 401 and the drilling rotary 105.

In detail, the second traction element 402 has a first end connected to the rod of the pull-down cylinder 102 by means of a pin 302 and a second end connected to a respective first end of the first traction element 401 by means of the pin 403. The first traction element 401 has a second end opposite with respect to the first and second traction element 402, which is connected to the rotary carriage 103 by means of a pin 303.

The flexibility of the first traction element 401 makes it easier to connect it to the rotary carriage 103. In fact, the operator in charge of the step of setting up the drilling machine 100 has the possibility, when inserting the connection pin 303, of slightly deforming the first flexible traction element 401 by means of his manual force, in order to mate the insertion seats of said pin 303.

Figure 5C:
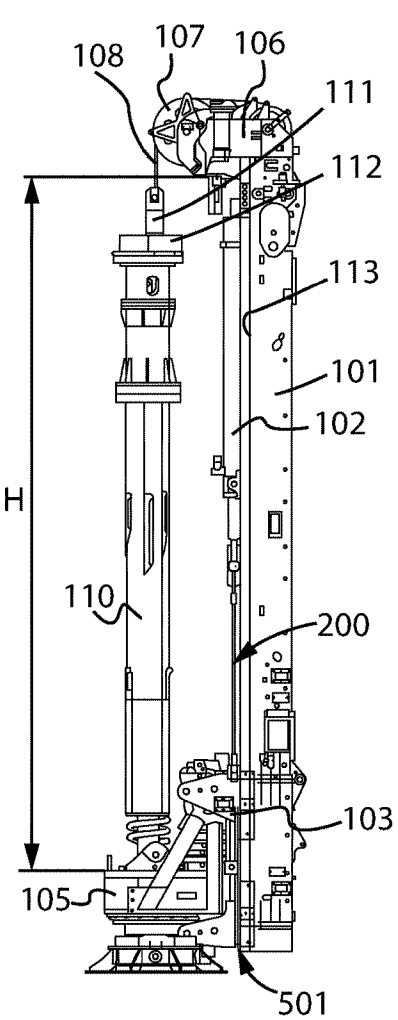
FIGS. 5A and 5B and 5C are schematic side elevation views of the guide tower in FIG. 4 illustrating a sequence of use of the relevant mounting tool provided.
Figure 5B:
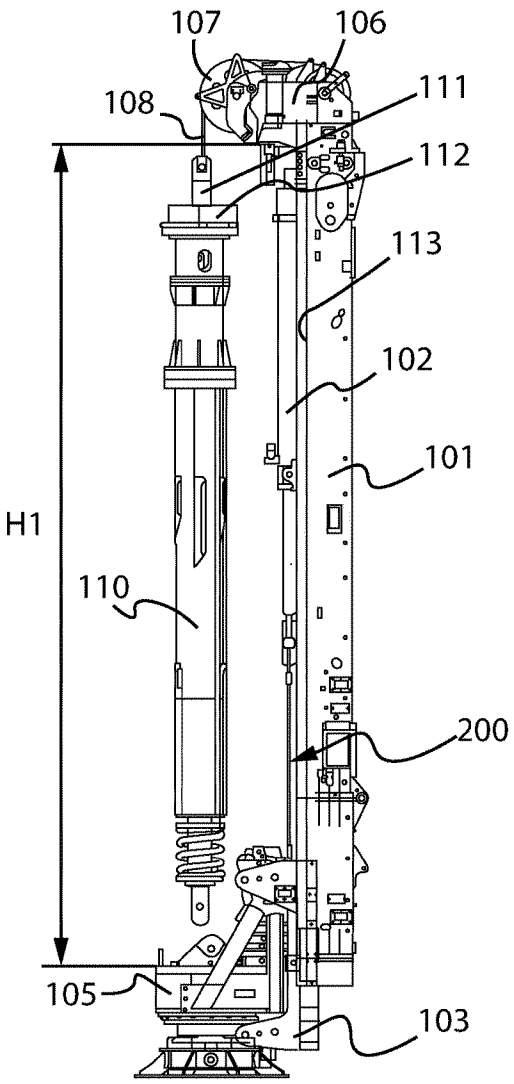
Figure 5A:
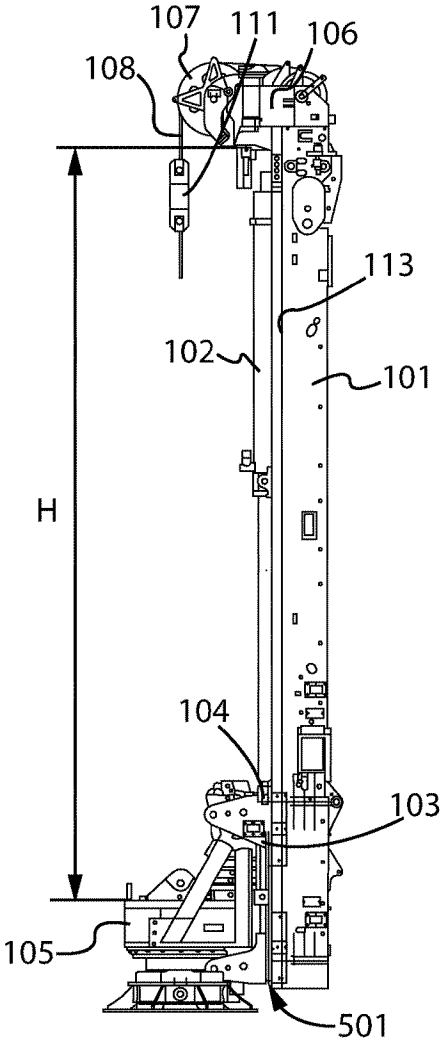

With reference to FIGS. 5A, 5B and 5C, there is illustrated a sequence of use of the mounting tool 200 and, accordingly, the relevant method of mounting, in accordance with the present invention.

For the sake of clarity, the undercarriage 100*b* and the body 100*a* of the drilling machine are not shown in FIGS. 5A-5C, but it should be understood that the guide tower 101 is connected to the drilling machine 100.

As can be seen in the schematic FIG. 5A, the guide tower 101 of the drilling machine 101 is shown without the kelly bar 110 and without the mounting tool 200, with the drilling rotary 105 in the lowest permitted position on the guide tower 101 determined by the sole actuation of the pull-down cylinder 102 which is in the maximum extension condition.

In the condition illustrated in FIG. 5A, a number of anti-sliding pads 501, are fixed on the guide tower 101 at a lower level than the rotary carriage 103 so as to stop the descent by gravity of the latter and the drilling rotary 105.

The anti-sliding pads 501 may consist of mechanical stop abutments which are fixed to the guide tower 101 or to the guides of the tower guide 101 by screw, pin or clamp engagement means.

Continuing the steps of the method of mounting the kelly bar 110, the fixing pin 104 connecting the rotary carriage 103 to the pull-down cylinder 102 is removed and the rod of the pull-down cylinder 102 is retracted, at least partially. In this situation, the drilling rotary 105 is temporarily kept locked by at least one anti-sliding pad 501 that prevents it from descending. With reference to the mounting tool 200 illustrated in FIG. 3, the traction element 301 is installed in a position interposed between the pull-down cylinder 102 and the rotary carriage 103 by connecting the ends of the traction element 301 to the pull-down cylinder 102 and to the rotary carriage 103 by means of respective fixing pins 302, 303.

With reference instead to the mounting tool 200 illustrated in FIG. 4, the first and second traction element 401,402 are installed in a position interposed between the pull-down cylinder 102 and the rotary carriage 103, proceeding according to the sequence below.

The second rigid traction element 402 is connected to the pull-down cylinder 102 by means of the respective pin 302.

The first end of the first flexible traction element 401 is connected to the second rigid traction element 402 by means of the pin 403.

The second end of the first flexible traction element 402 is connected to the rotary carriage 103, by means of the fixing pin 303.

The anti-sliding pads 501 are removed such that at least one traction element 401, 402, preferably the first traction element 401, is placed under traction by the weight of the drilling rotary 105, while the latter is retained by the pull-down cylinder 102.

Advantageously, the pull-down cylinder 102 may be retracted by a sufficient amount to place the first traction element 401 under traction before removing the anti-sliding pads 501.

Once the anti-sliding pads 501 have been removed, the pull-down cylinder 102 is extended to cause the rotary carriage 103 and the drilling rotary 105 to descend along the guide tower 101 until a "set-up configuration" of the drilling machine 100 is reached in which the drilling rotary 105 is at a distance H1 greater than the distance H. In this case, the rotary carriage 103 is guided, only for a portion of its height, by the guides of the guide tower 101.

More in detail, the upper guide seats of the rotary carriage 103 are fully engaged along their entire length to the guides of the guide tower 101, while the lower guide seats of the rotary carriage 103 may be engaged to the guide tower 101 even for only a limited part of their length.

The position that is reachable by the drilling rotary 105 illustrated in FIG. 5B and therefore the length of the section of the rotary carriage 103 protruding below the guides of the guide tower 101 and the value of the distance H1 depend on the length of the traction element 301 or of the traction elements 401, 402 of the mounting tool 200 which is interposed between the pull-down cylinder 102 and the rotary carriage 103. The distance H1, reachable by means of the mounting tool 200, allows mounting kelly bars 110 having a length equal to the distance H1, i.e. Increased with respect to the length of the kelly bars 110 normally used on such drilling machines 100.

Since the mounting tool 200 between the rotary carriage 103 and the pull-down cylinder 102 is used on the drilling machine 100 only during the set-up of the same and not in the working configuration, the condition of FIG. 5B with the guide seats of the rotary carriage 103 only partially engaged to the guide tower 101 cannot be achieved during the use of the drilling machine 100.

When the drilling rotary 105 is at distance H1, the rope 108 may be connected to the kelly bar 110 to lift the latter through actuation of the main winch 109 of the drilling machine 100. The kelly bar 110 is then lifted until its lower end is brought above the drilling rotary 105. When lifting the kelly bar 110, the guide tower 101 may be kept slightly inclined forward to avoid undesirable collisions between the kelly bar 110, the drilling rotary 105 and any other parts of the drilling machine 100.

Next, the kelly bar 110 is aligned with an annular passage of the drive sleeve of the drilling rotary 105 to make them coaxial.

During this last phase, it is possible to adjust the inclination of the guide tower 101 in order to bring it to a position close to the vertical and to favour the coaxiality of the kelly bar 110 with the annular passage of the drive sleeve of the drilling rotary 105.

Once the alignment has been made, the rod of the pull-down cylinder is retracted to achieve a rise of the rotary carriage 103 and of the drilling rotary 105 up to a distance from the head that is equal to or less than the distance H. During this rise, the annular passage of the drive sleeve of the drilling rotary 105 engages on the kelly bar 110 and rises sliding externally and coaxially thereto.

In an alternative variant of the method, before retracting the rod of the pull-down cylinder to return the rotary to the distance H, the kelly bar 110 can be moved by unwinding the winch rope 109, so that the kelly bar 110 descends through the annular passage of the drive sleeve of the drilling rotary 105 with a relative translation motion with respect to the rotary itself. At this point, as shown in FIG. 5C, at least one anti-sliding pad 501 is mounted, on the guide tower 101, below the rotary carriage 103 so as to prevent the drilling rotary 105 from sliding downwards.

Once the drilling rotary 105 is locked, it is possible to disassemble the mounting tool 200 by disengaging the traction element 301 or the traction elements 401, 402 from the drilling machine 100. In detail, the disassembly of the mounting tool 100 is performed by removing the pin between the rotary carriage 103 and the relevant pull-down element 301, 401 and by removing the pin between the pull-down cylinder 102 and the relevant pull-down element 301, 402.

After removal of the mounting tool 200, the pull-down cylinder 102 is extended up to the seat of the pin on the rotary carriage 103. At this point, the relevant pin 104 is inserted between the rod of the pull-down cylinder 102 and the rotary carriage 103.

All anti-sliding pads 501 are again removed to allow the drilling rotary 105 to slide together with the rotary carriage 103 along the guide tower 101.

The digging tool can now be connected to the kelly bar 110 in order to put the machine in the "working configuration", i.e. ready to dig into the ground. The mounting method and the mounting tool described so far solve the problems encountered with the prior art and achieve important advantages.

First of all, according to the present invention it is possible to mount kelly bars of longer lengths than those normally used without having to disassemble or remove any component of the drilling machine, such as the drilling rotary or the rotary carriage. On the one hand, this allows improving all those drilling machines intended for use in environments and workspaces that are limited in height, such as areas under bridges, buildings or other similar existing structures, and on the other hand, it avoids or minimises all downtime and idle times for mounting the kelly bar.

Furthermore, it should be considered that the mounting method and the relevant mounting tool according to the present invention make it possible to quickly set up drilling machines with longer kelly bars in order to be able to reach high digging depths while keeping the overall dimensions in height rather limited.

The invention claimed is:

1. A method of mounting a kelly bar on a drilling machine, the method comprising:

setting a pull-down cylinder containing a rod in an extended condition to bring a rotary carriage and a drilling rotary to a distance H or to a position close to the distance on a guide tower;

locking the rotary carriage on the guide tower;

disengaging the rotary carriage from the pull-down cylinder;

switching the pull-down cylinder from the extended condition to a retracted condition by an extent at least equal to a length of a mounting tool provided with at least one traction element;

installing the mounting tool between the rod of the pull-down cylinder and the rotary carriage;

unlocking the rotary carriage on the guide tower;

switching the pull-down cylinder to the extended condition to bring the drilling rotary to a distance H1 greater than the distance H;

connecting a rope to the kelly bar;

lifting the kelly bar by operating a main winch of the drilling machine, up to bring a lower end of the kelly bar above the drilling rotary;

aligning the kelly bar with an annular passage of a drive sleeve of the drilling rotary;

retracting the rod of the pull-down cylinder to obtain a rise of the rotary carriage and the drilling rotary up to a point, which has a distance from a head of the guide tower that is equal to or less than the distance H, the retraction of the rod of the pull-down cylinder determining a sliding engagement of the annular passage of the drive sleeve of the drilling rotary to the kelly bar;

locking the rotary carriage on the guide tower;

disassembling the mounting tool by disengaging the at least one traction element between the rod of the pull-down cylinder and the rotary carriage;

switching the pull-down cylinder in to the extended condition;

connecting the rod of the pull-down cylinder to the rotary carriage; and unlocking the rotary carriage on the guide tower, wherein the head of the guide tower is provided with at least one pulley for the rope from the main winch of the drilling machine to engage one end of the kelly bar, directly or indirectly, through a rotatable element, to move the kelly bar;

the drilling rotary is slidingly engaged to the guide tower through the rotary carriage and has the driving sleeve with the annular passage for inserting and engaging the kelly bar;

the pull-down cylinder is engaged to the guide tower;

the pull-down cylinder is engaged to the rotary carriage and the drilling rotary via the rod of the pull-down cylinder to move the rotary carriage and the drilling rotary along the guide tower;

the retracted condition is a condition in which the rod of the pull-down cylinder is disposed within the pull-down cylinder;

the extended condition is a condition in which the rod of the pull-down cylinder is disposed outside the pull-down cylinder; and the distance H is defined by a maximum downward sliding of the rotary carriage controlled by the rod of the pull-down cylinder in the extended condition.

2. The method according to claim 1, further comprising:

before connecting the rope to the kelly bar, carrying out a forward inclination of the guide towel; and before or simultaneously with aligning the kelly bar to the annular passage of the drive sleeve of the drilling rotary, straightening the guide tower to a vertical direction.

3. The method according to claim 1, further comprising:

before retracting the rod of the pull-down cylinder to return the drilling rotary to the distance H, moving the kelly bar, by unwinding the rope to lead the kelly bar to cross the annular passage of the drive sleeve of the drilling rotary.

4. The method according to claim 1, wherein:

at least one of said locking the rotary carriage on the guide tower includes installing one or more stop pads on guides of the guide tower; and at least one of said unlocking the rotary carriage on the guide tower comprises disassembling the one or more stop pads from the guides of the guide tower.

5. The method according to claim 1, wherein said installing the mounting tool between the rod of the pull-down cylinder and the rotary carriage includes:

connecting one end of a rigid traction element of the mounting tool to the rod of the pull-down cylinder using at least one pin; and connecting the other end of the rigid traction element of the rigid mounting tool to the rotary carriage using at least one pin.

6. The method according to claim 1, wherein said installing the mounting tool between the rod of the pull-down cylinder and the rotary carriage includes:

connecting one end of a first flexible traction element of the mounting tool to the rotary carriage using at least one pin;

connecting another end of the first flexible traction element of the mounting tool to one end of a second rigid traction member of the mounting tool using at least one pin; and connecting another end of the second rigid traction element of the mounting tool to one end of the rod of the pull-down cylinder using at least one pin.

7. The method according to claim 6, further comprising:

after said installing the mounting tool and before said unlocking the drilling rotary, adjusting the pull-down cylinder so that the pull-down cylinder is in the retracted condition of a measure sufficient to put under tension the first flexible traction element of the mounting tool.

8. A drilling machine, comprising:

a guide tower equipped with a head provided with at least one pulley;

a main winch equipped with a rope to engage, directly or indirectly, through a rotating element, one end of a kelly bar to move the kelly bar;

a drilling rotary slidingly engaged to the guide tower via a rotary carriage and having a driving sleeve having an annular passage for inserting and engaging the kelly bar;

a pull-down cylinder, wherein the pull-down cylinder is engaged to the guide towel, the pull-down cylinder has a rod and is engageable to the rotary carriage and the drilling rotary via the rod to move the rotary carriage and the drilling rotary along the guide tower, the pull-down cylinder switches between a retracted condition in which the rod is provided inside the pull-down cylinder and an extended condition in which the rod is provided outside the pull-down cylinder, and the pull-down cylinder defines, in the extended condition, a distance H of maximum downward sliding of the rotary carriage; and a mounting tool for mounting the kelly bar on the drilling machine, wherein the mounting tool contains at least one traction element installable between the rod of the pull-down cylinder and the rotary carriage of the drilling machine and is installed between the rod of the pull-down cylinder and the rotary carriage.

* * * * *